US011371409B2

(12) United States Patent
Fellman

(10) Patent No.: US 11,371,409 B2
(45) Date of Patent: Jun. 28, 2022

(54) FLUID CONTAINERS AND COMPONENTS THEREOF

(71) Applicant: PACCAR Inc, Bellevue, WA (US)

(72) Inventor: Martha-Ann Fellman, Bellevue, WA (US)

(73) Assignee: PACCAR Inc, Bellevue, WA (US)

( * ) Notice: Subject to any disclaimer, the term of this patent is extended or adjusted under 35 U.S.C. 154(b) by 211 days.

(21) Appl. No.: 16/418,700

(22) Filed: May 21, 2019

(65) Prior Publication Data

US 2020/0370457 A1 Nov. 26, 2020

(51) Int. Cl.
*F01N 3/20* (2006.01)

(52) U.S. Cl.
CPC ..... *F01N 3/2066* (2013.01); *F01N 2610/02* (2013.01); *F01N 2610/1413* (2013.01)

(58) Field of Classification Search
CPC ..... F01N 2610/1413; B01D 35/027; B60K 15/01; B60K 15/00; B60K 15/013; B60K 2015/0458; B60K 2015/049; B60K 15/04
USPC ..... 220/562, 86.1, 86.2, 86.3, 86.4
See application file for complete search history.

(56) References Cited

U.S. PATENT DOCUMENTS

| | | | | |
|---|---|---|---|---|
| 5,242,075 | A * | 9/1993 | Ott | B60K 15/0406 184/105.1 |
| 5,390,808 | A * | 2/1995 | Choma | B21D 39/06 220/86.2 |
| 8,919,393 | B2 * | 12/2014 | Budzyk | B60K 15/04 141/290 |
| 2009/0321441 | A1 * | 12/2009 | Horlacher | B60K 15/04 220/86.2 |
| 2013/0248048 | A1 * | 9/2013 | Behnamrad | B60K 15/04 141/311 R |
| 2017/0136873 | A1 * | 5/2017 | Nanyoshi | B60K 15/05 |

OTHER PUBLICATIONS

"Diesel engines—$NO_x$ reduction agent AUS 32—Part 4: Refilling interface", *Draft International Standard ISO/DIS 22241-4*, International Organization for Standardization, 2006, 17 pages.
Home Page, Five Star DefWebsite, 2019, <FiveStarDEF.com>, 6 pages.

* cited by examiner

*Primary Examiner* — Jeffrey R Allen
(74) *Attorney, Agent, or Firm* — Seed Intellectual Property Law Group LLP

(57) ABSTRACT

A fluid container includes a tank, a magnetic ring, and an adaptor coupled to the tank via an o-ring seal. The magnetic ring includes two half-ring portions that, when assembled, form a full magnetic ring. The fluid container can be used to store DEF or other fluids. Assembling the fluid container includes positioning the magnetic ring within a groove formed in an outer surface of a conduit of the tank, and threading the adaptor onto the conduit to lock the magnetic ring in place.

16 Claims, 8 Drawing Sheets

FLUID CONTAINERS AND COMPONENTS THEREOF

BACKGROUND

Technical Field

The present disclosure relates generally to fluid containers and various components thereof, such as components of fluid ports for fluid containers.

Description of the Related Art

Containers are used to store and transport a wide variety of fluids, including a variety of liquids and a variety of gases. Many fluids are dangerous in one or more ways, and may be flammable, explosive, radioactive, corrosive, poisonous, and/or toxic to human or environmental health. Thus, a variety of containers and ports for containers have been developed to assist in ensuring that fluids can be safely supplied to and withdrawn from the containers. Further, in applications where different fluids are supplied to different containers, a variety of containers and ports for containers have been developed to assist in ensuring that fluids are not inadvertently supplied to an unintended container. Nevertheless, there remains room for improvement in such containers and ports for such containers.

BRIEF SUMMARY

A diesel exhaust fluid container may be summarized as comprising: a tank having an interior, a wall that separates the interior from an external environment, and a conduit that extends through the wall from a first side of the wall to a second side of the wall, wherein the conduit has an outer surface and a groove that extends circumferentially around the outer surface; a magnetic ring positioned within the groove; and an adaptor threaded onto the conduit, wherein the magnetic ring is locked within the groove by the adaptor.

Another diesel exhaust fluid container may be summarized as comprising: a tank having an interior, a wall that separates the interior from an external environment, and a conduit that extends through the wall from a first side of the wall to a second side of the wall, wherein the conduit has an outer surface; a magnetic ring in direct physical contact with the outer surface of the conduit; and an adaptor threaded onto the conduit, wherein the magnetic ring is held in direct physical contact with the outer surface of the conduit by the adaptor.

The diesel exhaust fluid container may comply with ISO 22241. The conduit may include a proximal portion adjacent to the wall and having a first outer diameter, an intermediate portion adjacent to the proximal portion and having a second outer diameter smaller than the first outer diameter, and a third portion adjacent to the intermediate portion and having a third outer diameter smaller than the second outer diameter. The magnetic ring may have a proximal portion having a proximal cylindrical inner surface having a first inner diameter, and a distal portion having a distal cylindrical inner surface having a second inner diameter smaller than the first inner diameter. The second outer diameter may match the first inner diameter and the third outer diameter may match the second inner diameter. The magnetic ring may have an outer surface having a fourth outer diameter and the fourth outer diameter may match the first outer diameter. The adaptor may have an inner surface having a third inner diameter, wherein the third inner diameter matches the first and fourth outer diameters. The magnetic ring may extend 360 degrees around the outer surface of the conduit.

A fluid port for a diesel exhaust fluid container may be summarized as consisting of: a conduit that extends through a tank wall from a first side of the tank wall to a second side of the tank wall, wherein the conduit has an outer surface; a magnetic ring mounted on the outer surface of the conduit, wherein the magnetic ring includes a first half ring and a second half ring; an adaptor threaded onto the conduit; and an o-ring that seals the adaptor to the conduit. The o-ring may be in direct physical contact with a distal end of the conduit, may be in direct physical contact with a proximal-facing surface of the adaptor, and/or may be seated within a groove in a proximal-facing surface of the adaptor.

DETAILED DESCRIPTION

Figure 1:
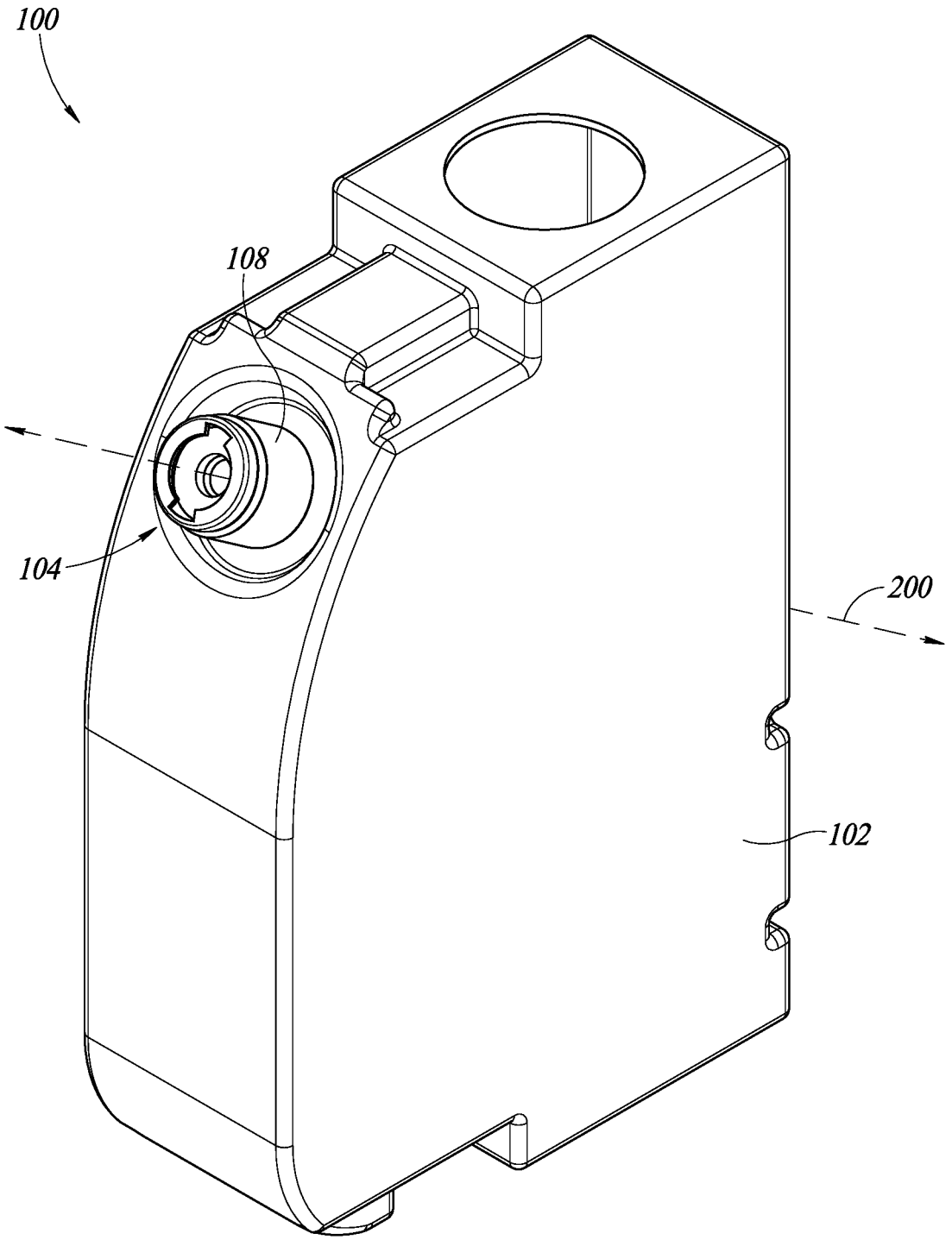
FIG. 1 illustrates a perspective view of a fluid container.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Also, as used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The use of ordinals such as first, second and third does not necessarily imply a ranked sense of order, but rather may only distinguish between multiple instances of an act or structure.

Terms of geometric alignment are used herein. Any components of the embodiments that are illustrated, described, or claimed herein as being aligned, arranged in the same direction, parallel, or having other similar geometric relationships with respect to one another have such relationships in the illustrated, described, or claimed embodiments. In alternative embodiments, however, such components can have any of the other similar geometric properties described herein indicating alignment with respect to one another. Any components of the embodiments that are illustrated, described, or claimed herein as being not aligned, arranged in different directions, not parallel, perpendicular, transverse, or having other similar geometric relationships with respect to one another, have such relationships in the illustrated, described, or claimed embodiments. In alternative embodiments, however, such components can have any of the other similar geometric properties described herein indicating non-alignment with respect to one another.

Various examples of suitable dimensions of components and other numerical values may be provided herein. In the illustrated, described, and claimed embodiments, such dimensions are accurate to within standard manufacturing tolerances unless stated otherwise. Such dimensions are examples, however, and can be modified to produce variations of the components and systems described herein. In various alternative embodiments, such dimensions and any other specific numerical values provided herein can be approximations wherein the actual numerical values can vary by up to 1, 2, 5, 10, 15 or more percent from the stated, approximate dimensions or other numerical values.

FIG. 1 illustrates a fluid container 100. As illustrated in FIG. 1, the fluid container 100 includes a vessel, receptacle, or tank 102 and a fluid port 104 formed therein for receiving or dispending fluids from within the tank 102. In some embodiments, the fluid container 100 and its tank 102 are designed, structured, or configured as a diesel exhaust fluid (DEF) container and tank, respectively, and are designed, structured, or configured to receive, hold, store, and/or dispense DEF. Embodiments of the present disclosure are not limited to fluid containers that include a vessel, receptacle, or tank designed, structured, or configured to receive, hold, store and/or dispense DEF. Embodiments of the present disclosure include fluid containers that include a vessel, receptacle, or tank designed, structured, or configured to receive, hold, store and/or dispense fluids other than DEF.

DEF is a liquid, aqueous, urea solution, and may be referred to as "AUS 32" (AUS being an acronym for aqueous urea solution). In some embodiments, DEF may comprise 32.5 percent urea and 67.5 percent deionized water, and may conform to one or more generally accepted standards promulgated by one or more accepted standards bodies, such as ISO 22241. In some embodiments, DEF is used in diesel vehicles to lower nitrous oxide emissions. DEF tanks are often filled at the same locations and at the same time that diesel fuel tanks are filled with diesel fuel. Thus, there is concern that DEF may be inadvertently supplied to a diesel fuel tank or that diesel fuel may be inadvertently supplied to a DEF tank.

Many DEF tanks are manufactured to include a port or a "refilling interface" in accordance with ISO 22241-4 (titled "Diesel engines—NOx reduction agent AUS 32—Part 4: Refilling Interface"). Such tanks and their ports help to ensure that a DEF filling nozzle can only dispense DEF into a DEF tank. In particular, such tanks and their ports include magnetic components that interact with corresponding magnetic components and magnetic switches in DEF filling nozzles to allow the DEF to be dispensed by the DEF filling nozzle into the DEF tank. Mis-fueling of DEF by a DEF filling nozzle into a gasoline or diesel tank is prevented because gasoline and diesel tanks are generally not equipped with magnetic components to allow the DEF filling nozzle to dispense DEF. Mis-fueling of gasoline or diesel into a DEF tank is prevented because the DEF tank ports or refilling interfaces are generally too small to accommodate a gasoline or diesel filling nozzle. Except where inconsistent or incompatible with the features described herein, any of the features of existing DEF tanks and their ports or refilling interfaces, such as those described in ISO 22241 and ISO 22241-4 in particular, may be combined with and incorporated into the embodiments described herein.

Figure 2:
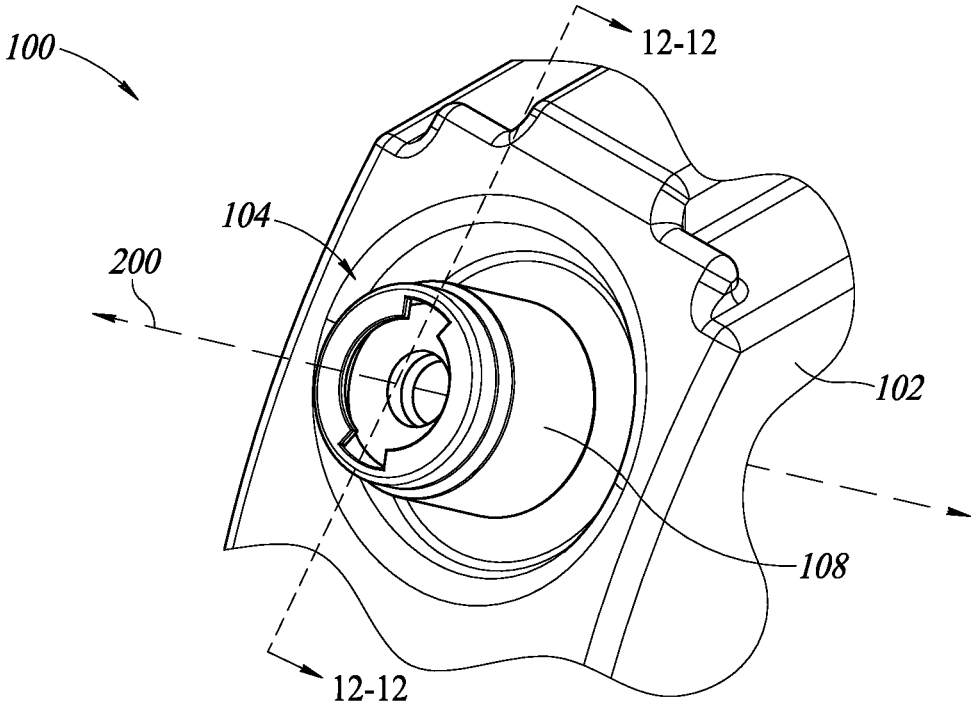
FIG. 2 illustrates an enlarged view of a portion of the fluid container of FIG. 1 from a perspective matching that used in FIG. 1.
Figure 3:
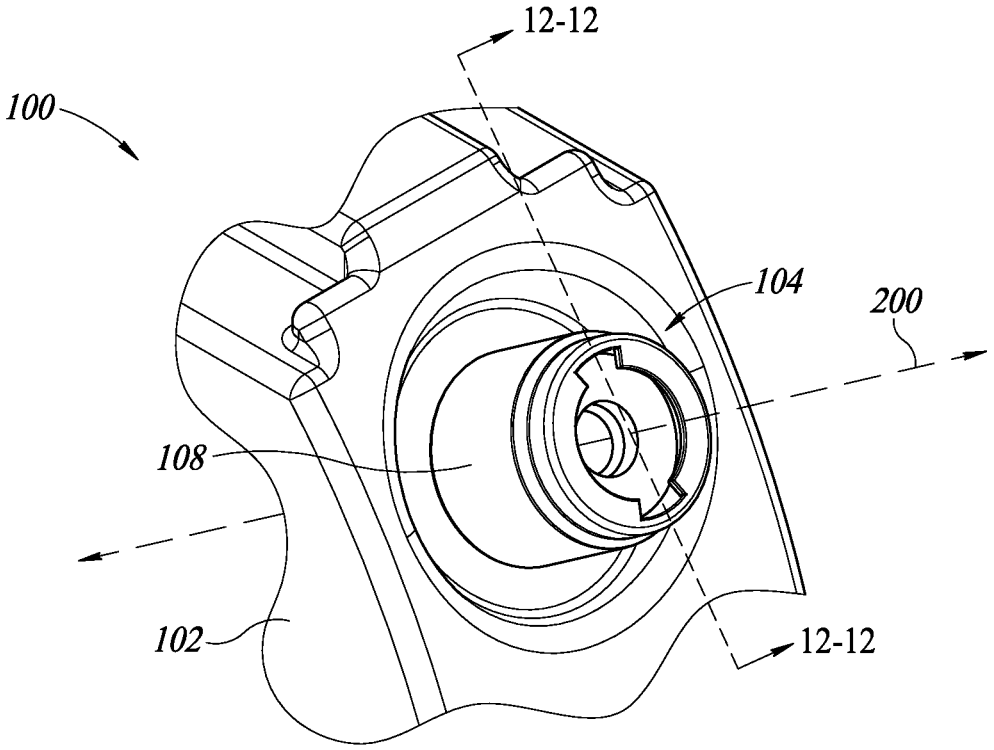
FIG. 3 illustrates another enlarged view of a portion of the fluid container of FIG. 1 from a perspective different than that used in FIGS. 1 and 2.
Figure 4:
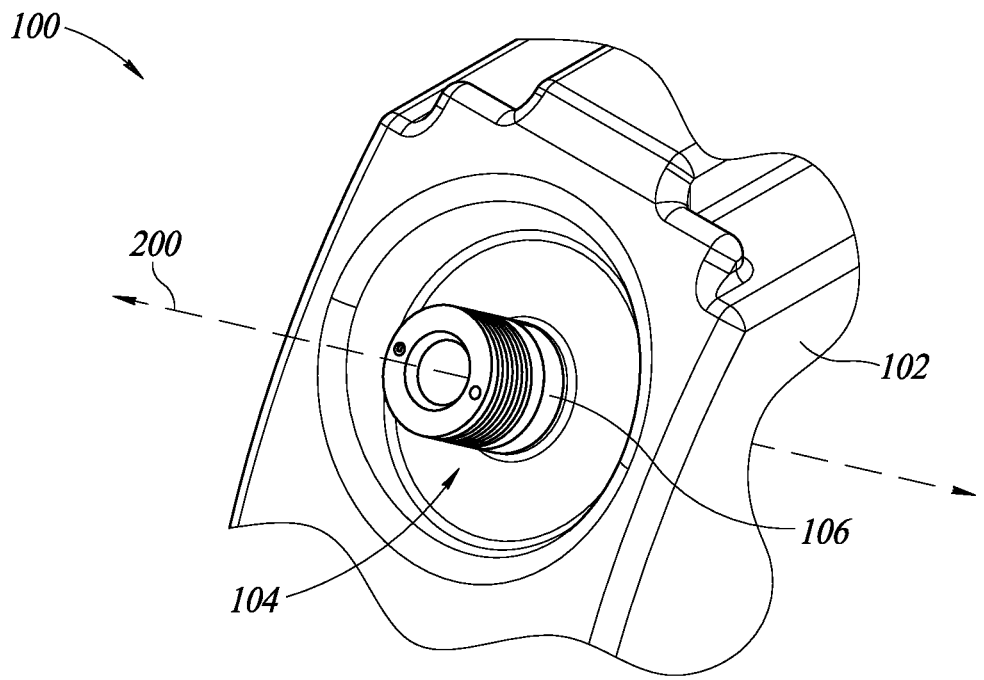
FIG. 4 illustrates the same portion of the fluid container of FIG. 1 illustrated in FIG. 2, with one component removed to illustrate additional features of the remaining components.
Figure 5:
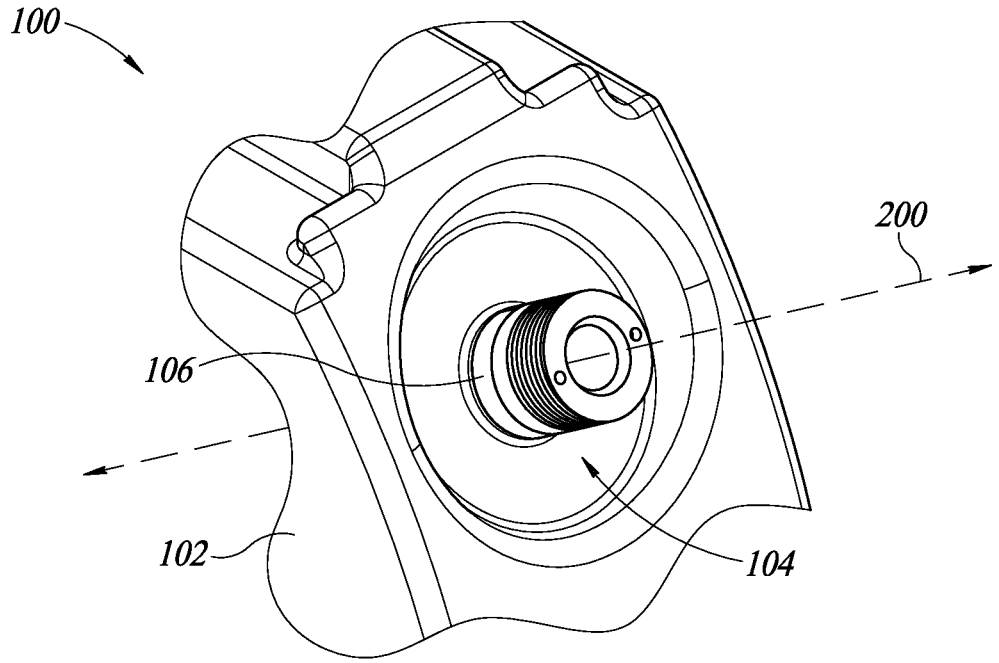
FIG. 5 illustrates the same portion of the fluid container of FIG. 1 illustrated in FIG. 3, with the component removed in FIG. 4 removed to illustrate additional features of the remaining components.
Figure 6:
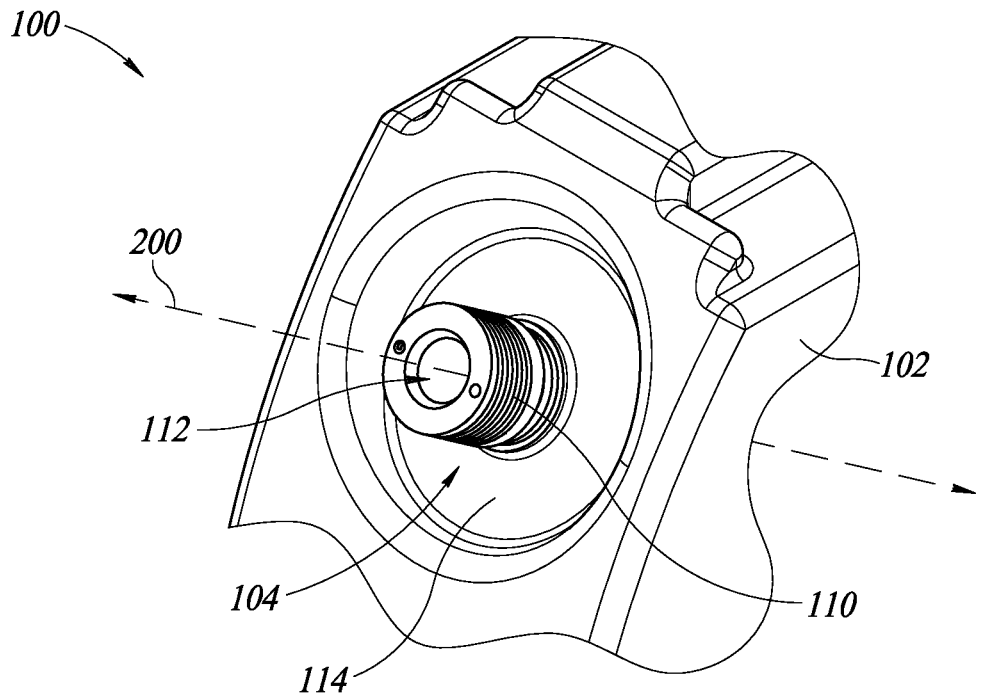
FIG. 6 illustrates the same portion of the fluid container of FIG. 1 illustrated in FIG. 4, with two additional components removed to illustrate additional features of the remaining component.
Figure 7:
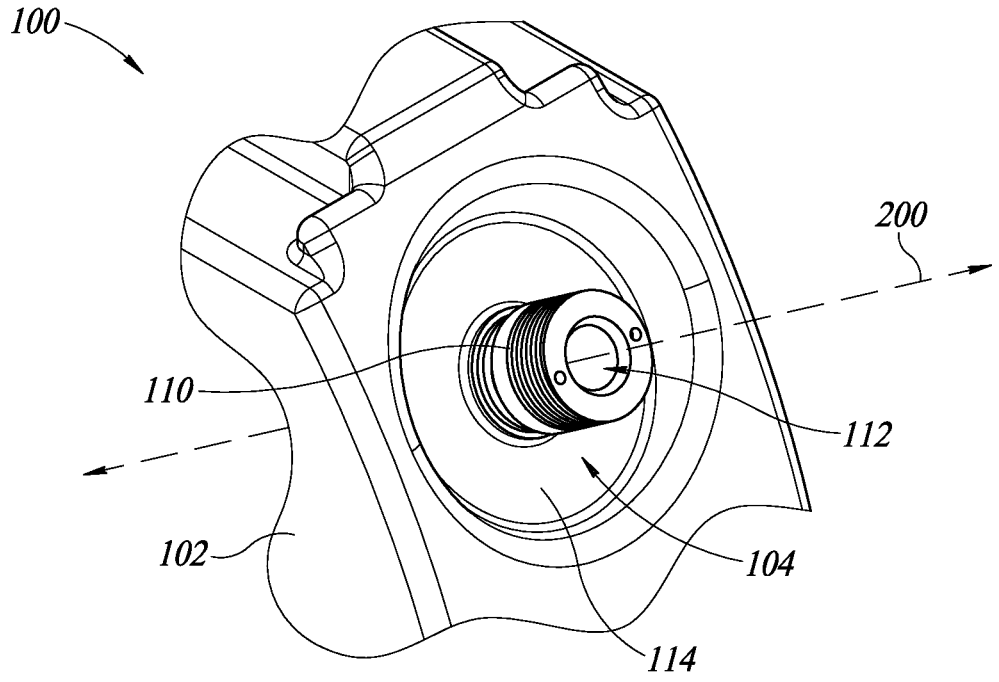
FIG. 7 illustrates the same portion of the fluid container of FIG. 1 illustrated in FIG. 5, with the two components removed in FIG. 6 removed to illustrate additional features of the remaining component.
Figure 12:
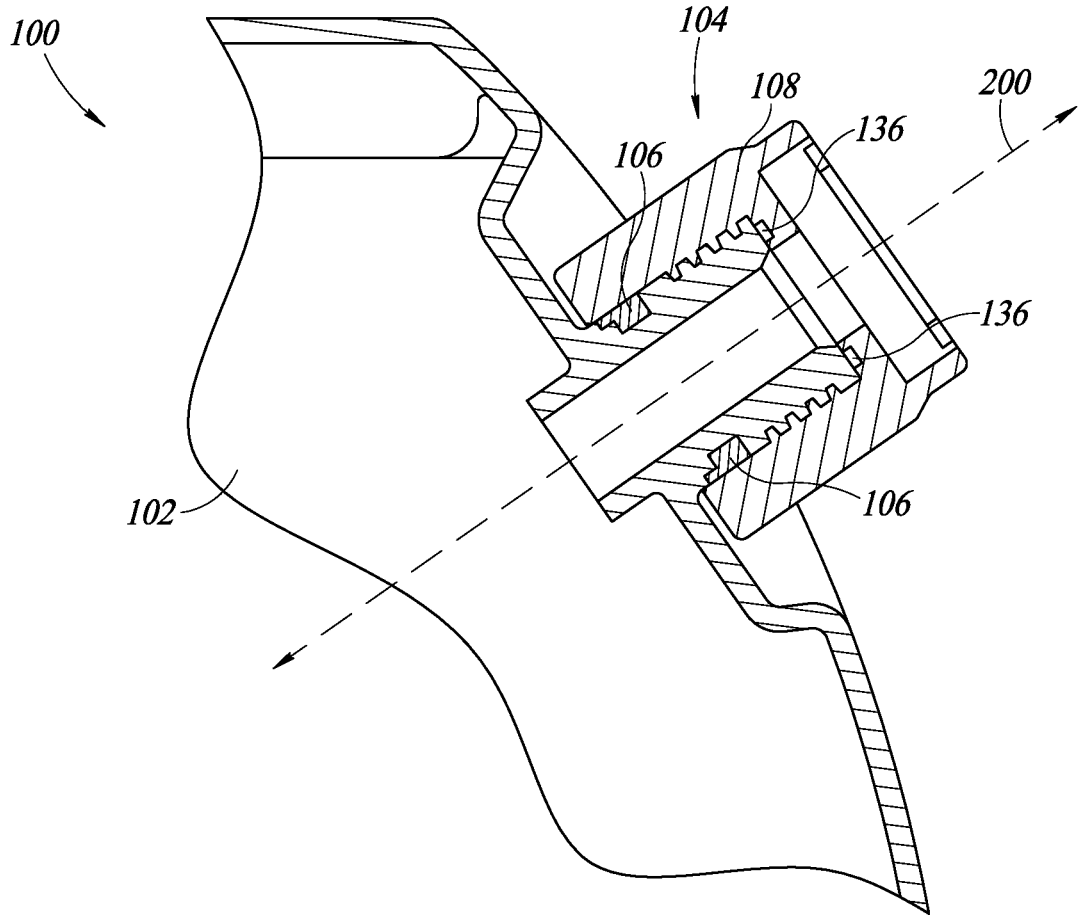
FIG. 12 illustrates a cross-sectional view of the fluid container of FIG. 1, along line 12-12 shown in FIGS. 2 and 3.
Figure 15:
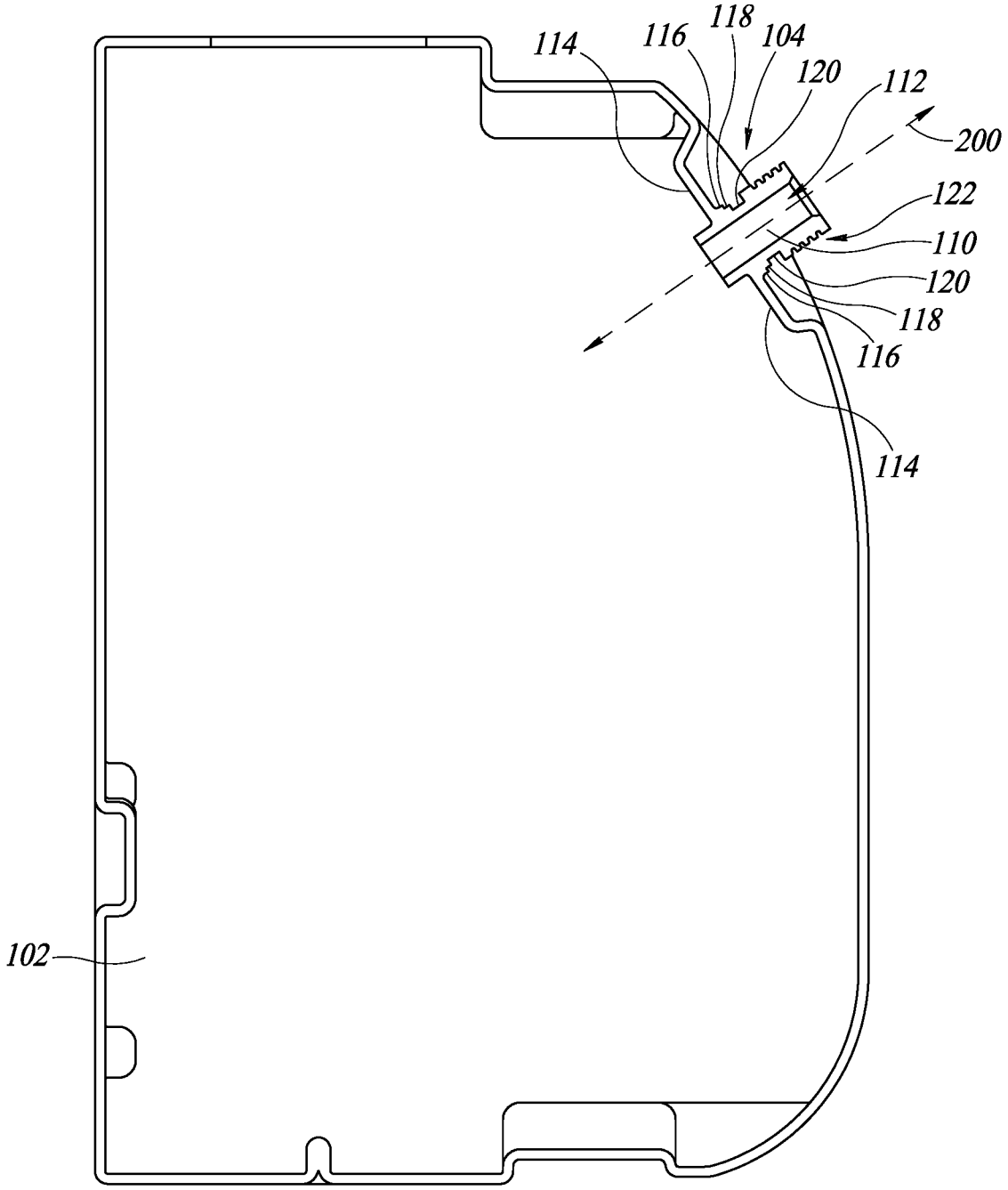
FIG. 15 illustrates a cross-sectional view of a tank of the fluid container of FIG. 1, along line 12-12 shown in FIGS. 2 and 3.

FIGS. 2 and 3 illustrate close up views of the fluid port 104 of the fluid container 100 from two different perspective views. FIG. 12 illustrates a cross-sectional view, taken along line 12-12 in FIGS. 2 and 3, of the fluid port 104 of the fluid container 100. As illustrated in FIG. 12, the fluid port 104 comprises portions of the fluid tank 102, a magnetic ring 106, and a cover or adaptor 108. As also illustrated in FIG. 12, the fluid port 104 has an overall cylindrical shape with a central longitudinal axis 200, and various components of the fluid port 104 also have overall cylindrical shapes with respective central longitudinal axes generally parallel to and coincident with the central longitudinal axis 200. FIGS. 4 and 5 illustrate the fluid container 100 with the adaptor 108 removed, to illustrate more clearly the magnetic ring 106 mounted on portions of the fluid tank 102. FIGS. 6, 7, and 15 illustrate the portions of the fluid tank 102 that make up components of the fluid port 104 in isolation, with the magnetic ring 106 and the adaptor 108 removed, to illustrate more clearly the portions of the fluid tank 102 that make up components of the fluid port 104.

As illustrated in FIGS. 6, 7, and 15, the tank 102 includes a hollow, generally cylindrical conduit 110 that has a cylindrical internal passage 112 that extends along the length thereof. Both the conduit 110 and its internal passage 112 have central longitudinal axes that are coincident with the central longitudinal axis 200. The conduit 110 extends through an outer, exterior wall 114 of the tank 102, from a first location inside the tank 102 with respect to the wall 114 to a second location outside the tank 102 with respect to the wall 114. In some embodiments, the wall 114 can be recessed inward toward an interior of the tank 102 with respect to a surrounding portion and surrounding walls of the tank 102. In some cases, less than ⅕, or greater than ⅕ and less than ¼, or greater than ⅕ and less than ⅓ of a length of the conduit 110 along its central longitudinal axis is located inside the tank 102 with respect to the wall 114, and greater than ⅘, or less than ⅘ and greater than ¾, or less than ⅘ and greater than ⅔ of a length of the conduit 110 along its central longitudinal axis is located outside the tank 102 with respect to the wall 114.

As also illustrated in FIGS. 6, 7, and 15, the portion of the conduit 110 that extends outward from the wall 114 with respect to an interior of the tank 102 has a proximal end adjacent to the wall 114 and a distal end opposite to its proximal end, such that its distal end is its end farthest from the wall 114. The portion of the conduit 110 that extends outward from the wall 114 also has an exterior surface and features formed in the exterior surface to allow other components, such as the magnetic ring 106 and the adaptor 108, to be coupled to and mated with the outer surface of the conduit 110. For example, the conduit 110 may include one or more holes or apertures extending longitudinally into a distal end surface of the conduit 110, into which screws or other fasteners can extend to fasten the adaptor 108 to the conduit 110. In other implementations, the conduit 110 may include such holes but the holes may be unused. In other implementations, the conduit 110 may not include such holes.

As another example, the conduit 110 has a first, relatively wide proximal portion 116 at its proximal end adjacent to the wall 114, a second, intermediate portion 118 adjacent and immediately distal to its proximal portion 116, and a third, relatively narrow portion 120 adjacent and immediately distal to its intermediate portion 118. The relatively wide proximal portion 116 has a cylindrical outer surface having a first outer diameter, the intermediate portion 118 has a cylindrical outer surface having second outer diameter that is less than the first outer diameter, and the relatively narrow portion 120 has a cylindrical outer surface having a third outer diameter that is less than the first and second outer diameters. Thus, the relatively wide proximal portion 116, the intermediate portion 118, and the relatively narrow portion 120 form a set of steps that extend from the wall 114 distally along the length of the conduit 110 and radially inward toward the central longitudinal axis 200. In some embodiments, the radially extending surfaces that extend between the outer cylindrical surfaces of the relatively wide proximal portion 116, the intermediate portion 118, and the relatively narrow portion 120 are oriented and extend completely radially, inward and/or outward, and at right angles with respect to such outer cylindrical surfaces.

The outer cylindrical surface of the intermediate portion 118 forms a bottom end or bottom surface of a first groove cut into or formed in the outer surface of the conduit 110 with respect to the relatively wide proximal portion 116. Similarly, the outer cylindrical surface of the relatively narrow portion 120 forms a bottom end or bottom surface of a second groove cut into or formed in the outer surface of the conduit 110 with respect to the relatively wide proximal portion 116, where a depth of the second groove is deeper than a depth of the first groove. As discussed in greater detail elsewhere herein, the magnetic ring 106 can be seated within these first and second grooves of the conduit 110 and secured therein when the adaptor 108 is coupled to the conduit 110.

As also illustrated in FIGS. 6, 7, and 15, the conduit 110 has a threaded portion 122 that extends from a location adjacent and immediately distal to the relatively narrow portion 120, to the distal end of the conduit 110. The threaded portion 122 has a cylindrical outer surface having a fourth outer diameter that is about or the same as the first outer diameter of the relatively wide proximal portion 116. The threaded portion 122 also has helical threads cut into its cylindrical outer surface. As discussed in greater detail elsewhere herein, the adaptor 108 can be threaded onto the threads of the threaded portion 122 to couple and secure the adaptor 108 and the magnetic ring 106 to the conduit 110. Embodiments of the present disclosure are not limited to utilizing helical threads to secure the adapter 108 and the magnetic ring 106 to the conduit 110. In accordance with embodiments of the present disclosure, structures or devices other than helical threads, for example, locking rings or compression fittings, can be used to couple and secure the adapter 108 and the magnetic ring 106 to the conduit 110.

Figure 9:
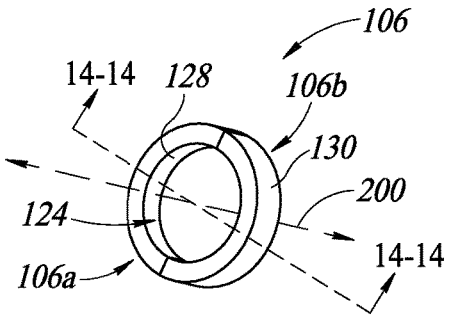
FIG. 9 illustrates a perspective view of two components of the fluid port of the fluid container of FIG. 1, from a perspective matching that used in FIG. 8.
Figure 11:
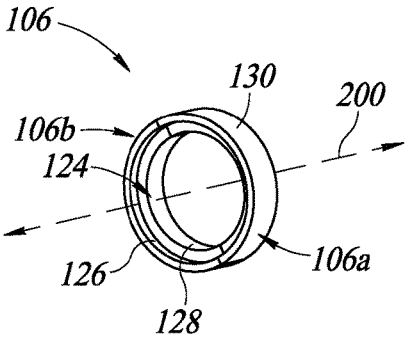
FIG. 11 illustrates a perspective view of the two components illustrated in FIG. 9 from a perspective matching that used in FIG. 10.
Figure 14:
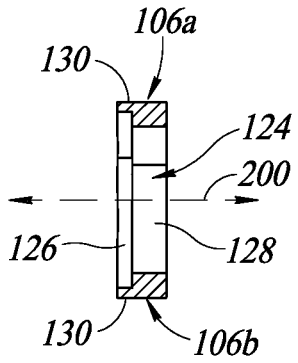
FIG. 14 illustrates a cross-sectional view of the components of the fluid port of the fluid container of FIGS. 9 and 11, along line 14-14 shown in FIG. 9.

FIGS. 9, 11, and 14 illustrate the magnetic ring 106 in isolation, with the tank 102 and the adaptor 108 removed, to illustrate more clearly the features of the magnetic ring 106. As illustrated in FIGS. 9, 11, and 14, the magnetic ring 106 includes two distinct components, namely, a first half ring 106*a* and a second half ring 106*b*. When the first and second half rings 106*a* and 106*b* are assembled and coupled together, they collectively form the ring 106, which has an overall cylindrical shape having a central longitudinal axis coincident with the axis 200 and a stepped inner surface 124. The magnetic ring 106 has features formed in the stepped inner surface 124 to allow the magnetic ring 106 to be coupled to and mated with other components, such as a proximal portion of the conduit 110 of the tank 102. For example, the stepped inner surface 124 of the magnetic ring 106 has a first, relatively wide proximal portion 126 at a proximal end thereof and a second, relatively narrow distal portion 128 adjacent and immediately distal to the proximal portion 126.

The relatively wide proximal portion 126 has a cylindrical inner surface having a first inner diameter and the relatively narrow distal portion 128 has a cylindrical inner surface having a second inner diameter that is less than the first inner diameter. Thus, the relatively wide proximal portion 126 and the relatively narrow distal portion 128 form a set of steps that extend from a first, proximal end of the magnetic ring 106 to a second, distal end of the magnetic ring 106 along the central longitudinal axis 200 and radially inward toward the central longitudinal axis 200. In some embodiments, the radially extending surfaces that extend between the inner cylindrical surfaces of the relatively wide proximal portion 126 and the relatively narrow distal portion 128 are oriented and extend completely radially, inward and/or outward, and at right angles with respect to such inner cylindrical surfaces.

In some embodiments, the set of steps formed in the outer surface of the conduit 110 of the tank 102 and the set of steps formed in the inner surface 124 of the magnetic ring 106 are complementary to one another, so that respective surfaces thereof can be abutted against and mated to one another. For example, the outer diameter of the intermediate portion 118 of the conduit 110 can correspond to, match, or be the same as the inner diameter of the proximal portion 126 of the magnetic ring 106. Similarly, the outer diameter of the relatively narrow portion 120 of the conduit 110 can correspond to, match, or be the same as the inner diameter of the distal portion 128 of the magnetic ring 106. Thus, the magnetic ring 106 can be positioned on and extend circumferentially around the conduit 110, such as within the grooves formed by the decreased outer diameters of the intermediate portion 118 and the relatively narrow portion 120 of the magnetic ring 106.

In such embodiments, the outer cylindrical surface of the intermediate portion 118 rests against the inner cylindrical surface of the proximal portion 126 of the magnetic ring 106. In such embodiments, the outer cylindrical surface of the relatively narrow portion 120 also rests against the inner cylindrical surface of the distal portion 128 of the magnetic ring 106. In such embodiments, the radially extending surface that extends between the outer cylindrical surfaces of the intermediate portion 118 and the relatively narrow portion 120 also rests against the radially extending surface that extends between the inner cylindrical surfaces of the relatively wide proximal portion 126 and the relatively narrow distal portion 128 of the magnetic ring 106.

In such embodiments, the radially extending surface that extends between the outer cylindrical surfaces of the relatively wide proximal portion 116 and the intermediate portion 118 also rests against a proximal end of the magnetic ring 106 that extends from the inner cylindrical surface of the relatively wide proximal portion 126 to an outer surface 130 of the magnetic ring 106. In such embodiments, a radially extending surface that extends between the outer cylindrical surfaces of the relatively narrow portion 120 and the threaded portion 122 rests against a distal end of the magnetic ring 106 that extends from the inner cylindrical surface of the relatively narrow distal portion 128 to the outer surface 130 of the magnetic ring 106. Further, the outer surface 130 of the magnetic ring 106 can have an outer diameter that corresponds to, matches, or is the same as the first outer diameter of the relatively wide proximal portion 116. Thus, when the magnetic ring 106 is mounted on and coupled to the outer surface(s) of the conduit 110, the outer surface of the magnetic ring 106 is flush with the outer surfaces of the relatively wide proximal portion 116 of the conduit 110 and/or the threaded portion 122.

As noted above, the magnetic ring 106 comprises the first half ring 106*a* and the second half ring 106*b*. As illustrated in FIGS. 9, 11, and 14, the first half ring 106*a* and the second half ring 106*b* each comprise one circumferential half of the magnetic ring 106. That is, the magnetic ring 106 is split in half along a plane that contains the central longitudinal axis 200 into the first half ring 106*a* and the second half ring 106*b*, which each extend 180 degrees about the central longitudinal axis 200. In other embodiments, the magnetic ring 106 may be split into additional portions, such as three, four, five, or more equally-sized individual components. Further, in other embodiments, the magnetic ring 106 may be split into portions that are not equally sized, such as two portions that extend 170 and 190 degrees, or 160 and 200 degrees about the central longitudinal axis 200.

The magnetic ring 106 may conform to one or more generally accepted standards promulgated by one or more accepted standards bodies, such as ISO 22241. For example, the magnetic ring 106 may have an outer diameter of 34 mm, an inner diameter (such as of its relatively narrow distal portion 128) of 24 mm, and a length along the central longitudinal axis 200 of 10 mm. The magnetic ring 106 may be made of neodymium iron boron (NdFeB). The magnetic ring 106 may have a remanence of 1.2-1.3 Tesla. The magnetic ring 106 may have a coercivity of 800-900 kA/m. The magnetic ring 106 may have a north pole located either at its proximal or its distal end.

Figure 8:
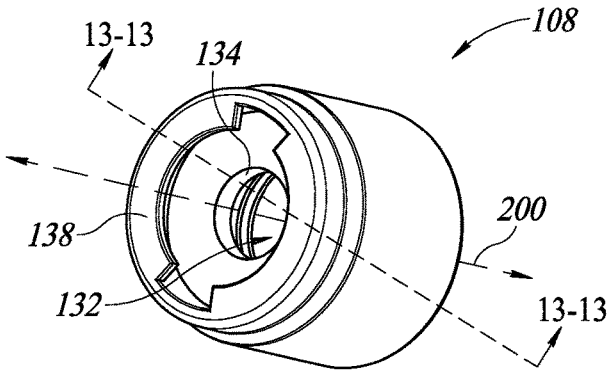
FIG. 8 illustrates a perspective view of a component of a fluid port of the fluid container of FIG. 1.
Figure 10:
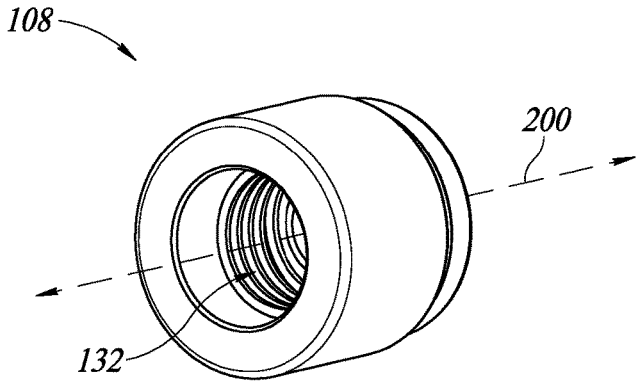
FIG. 10 illustrates a perspective view of the component illustrated in FIG. 8 from a perspective different than that used in FIG. 8.
Figure 13:
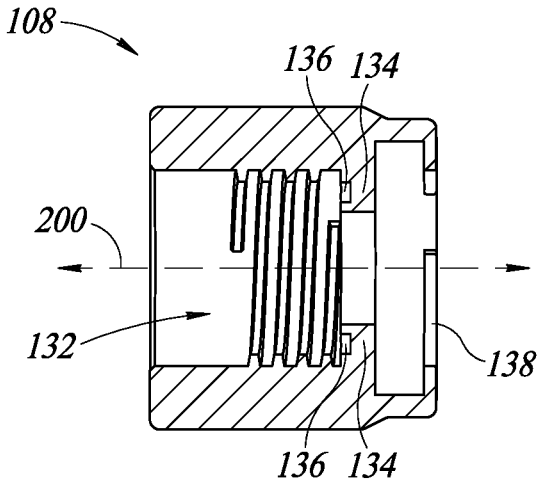
FIG. 13 illustrates a cross-sectional view of the component of the fluid port of the fluid container illustrated in FIGS. 8 and 10, along line 13-13 shown in FIG. 8.

FIGS. 8, 10, and 13 illustrate the adaptor 108 in isolation, with the tank 102 and the magnetic ring 106 removed, to illustrate more clearly the features of the adaptor 108. As illustrated in FIGS. 8, 10, and 13, the adaptor 108 has an overall cylindrical shape that has a cylindrical internal passage 132 that extends along the length thereof. Both the adaptor 108 and its internal passage 132 have central longitudinal axes that are coincident with the central longitudinal axis 200. The adaptor 108 has an inner surface and features formed in the inner surface to allow the adaptor 108 to be coupled to and mated with other components, such as the conduit 110 of the tank 102 and a DEF filling nozzle.

The inner surface of the adaptor 108 and the cylindrical internal passage 132 are each divided into a proximal portion and a distal portion thereof by a raised, radially inwardly extending, circumferential ridge 134. The circumferential ridge 134 extends radially inward from the rest of the adaptor 108, and defines a fluid port aperture at its radial center that is aligned with the central longitudinal axis 200 and configured to receive a DEF filling nozzle in conformance with relevant ISO standard(s). The proximal portions of the internal passage 132 and the inner surface of the adaptor 108 are threaded and include helical threads cut or otherwise formed in the proximal portion of the inner surface of the adaptor 108. The threads formed in the proximal portion of the inner surface of the adaptor 108 are complementary to the threads of the threaded portion 122 of the conduit 110, such that the proximal end of the adaptor 108 can extend over, and be threadedly coupled and secured to, the distal end of the conduit 110.

As with the helical threads of the threaded portion 122 of conduit 110, embodiments of the present disclosure are not limited to utilizing helical threads at the proximal portion of the inner surface of the adaptor 108 to couple and secure the proximal end of the adapter 108 to the distal end of the conduit 110. In accordance with embodiments of the present disclosure, structures or devices other than helical threads, for example, locking rings or compression fittings, can be used to couple and secure the proximal end of the adapter 108 to the distal end of the conduit 110.

A proximal-facing surface of the ridge 134 includes a proximal-facing groove that extends circumferentially about the fluid port aperture at the radial center of the circumferential ridge 134. A seal, a gasket, or an o-ring 136 is seated within this groove when the components of the fluid port 104 are assembled, such that the o-ring 136 provides a fluid-tight seal between the tank 102 and the adaptor 108, and more specifically, between the distal end of the conduit 110 of the tank 102 and the proximal-facing surface of the circumferential ridge 134 of the adaptor 108. The distal portion of the internal passage 132 is cylindrical and includes a smooth distal portion of the inner surface of the adaptor 108. The distal end of the adaptor 108 includes a radially inwardly extending, circumferential ridge 138. The circumferential ridge 138 extends radially inward from the distal end of the rest of the adaptor 108, and forms portions of a bayonet-style connector, which may be formed in accordance with relevant ISO standard(s), and to which a DEF filling nozzle and/or a cap may be coupled and secured using a bayonet-style connection, such as with protrusions of a connector of a DEF filling nozzle or of a cap being pushed through gaps in the circumferential ridge 138 and then rotated so they become locked in place and secured to the fluid port 104 within the undercut grooves formed between the circumferential ridges 134 and 138.

A method of assembling the fluid port 104 may begin by positioning the first half ring 106*a* and the second half ring 106*b* of the magnetic ring 106 within the grooves formed in the outer surface of the conduit 110 of the tank 102, to form the complete magnetic ring 106 within the grooves. The method may further include positioning the o-ring 136 within the groove formed in the proximal-facing surface of the ridge 134 of the adaptor 108, and then threading the threads in the proximal portion of the inner surface of the adaptor 108 onto the threads on the outer surface of the threaded portion 122 of the conduit 110 of the tank 102. The method may conclude by securing a cap to the distal end of the adaptor 108, such as by securing components of a bayonet-style connector of the cap to the components of the bayonet-style connector of the adaptor 108.

Once these actions are completed, as illustrated in FIG. 12, the proximal portion of the inner surface of the adaptor 108 abuts and covers the relatively wide proximal portion 116 of the outer surface of the conduit 110 of the tank 102 as well as the outer surface of the magnetic ring 106, thereby locking the magnetic ring 106 within the grooves formed in the outer surface of the conduit 110 and securing the magnetic ring 106 within the fluid port 104. Further, once these actions have been completed, the proximal-facing surface of the circumferential ridge 134 and the o-ring 136 positioned within the groove thereof, abut the distal end of the conduit 110 of the tank 102, thereby locking the o-ring 136 within the groove and securing the o-ring 136 within the fluid port 104.

A method of using the assembled fluid port 104 to fill the tank 102 with DEF may include disconnecting the cap from the adaptor 108, such as by un-doing the bayonet-style connection therebetween. The method may further include positioning a terminal end portion of a DEF filling nozzle within the fluid port 104. For example, the terminal end portion of the DEF filling nozzle may extend through the fluid port aperture at the radial center of the circumferential ridge 134, until a magnetic switch at the terminal end portion of the DEF filling nozzle is activated, or switched, due to its interaction with the magnetic ring 106. The method may further include rotating the DEF filling nozzle so that it is secured to the adaptor 108 by a bayonet-style connection, and then activating the DEF filling nozzle to dispense DEF into the tank 102 through the fluid port 104. The method may further include de-activating the DEF filling nozzle so that it stops dispending DEF into the tank 102, rotating the DEF filling nozzle to undo its bayonet-style connection to the adaptor 108, and then removing the DEF filling nozzle from the fluid port 104. The method may conclude by re-securing the cap to the distal end of the adaptor 108, such as by securing components of the bayonet-style connector of the cap to the components of the bayonet-style connector of the adaptor 108.

A method of disassembling the fluid port 104 may begin by disconnecting the cap from the adaptor 108, such as by un-doing the bayonet-style connection therebetween. The method may further include un-threading the threads in the proximal portion of the inner surface of the adaptor 108 from the threads on the outer surface of the threaded portion 122 of the conduit 110 of the tank 102, and then removing the o-ring 136 from the groove. The method may conclude by removing the first half ring 106*a* and the second half ring 106*b* of the magnetic ring 106 from the grooves formed in the outer surface of the conduit 110 of the tank 102.

The fluid port 104 can be assembled from exactly five distinct components, namely, the tank 102, including its conduit 110, the first half ring 106*a* and the second half ring 106*b* of the magnetic ring 106, the adaptor 108, and the o-ring 136 positioned within the groove. Each of these five components and the various respective features thereof described herein may be formed integrally or monolithically, rather than of separable sub-components. The fluid port 104 may include, or consist of or consist essentially of, only these five components. Such a fluid port 104 provides a simpler system and affords a simpler assembly procedure than previous DEF fluid ports, and thereby offers improvements in overall efficiency and reduces errors or other problems during assembly.

Any of the components of the fluid container 100 and the features thereof described herein may be made from any suitable materials. As examples, the tank 102 may be made of polyethylene such as HDPE or XLPE, fiberglass reinforced plastic, or metallic or metal alloy materials. Further, any of the components of the fluid container 100 and the features thereof described herein may have one or more corners or edges that are beveled or chamfered. While the magnetic ring 106 has been described herein as being formed from two distinct components (the first and second half-rings 106*a* and 106*b*), in some embodiments, the magnetic ring 106 is made of a single, integral, monolithic piece of magnetic material, such that the fluid port 104 can be assembled from exactly four, rather than five, distinct components. Further, while the adaptor 108 is described as being threadedly engaged with and coupled to the conduit 110 of the tank 102, any suitable connection (such as mechanical fasteners such as screws or bolts, or adhesives such as glues, or welding) may be used in place of the threaded connection.

Figure 16:
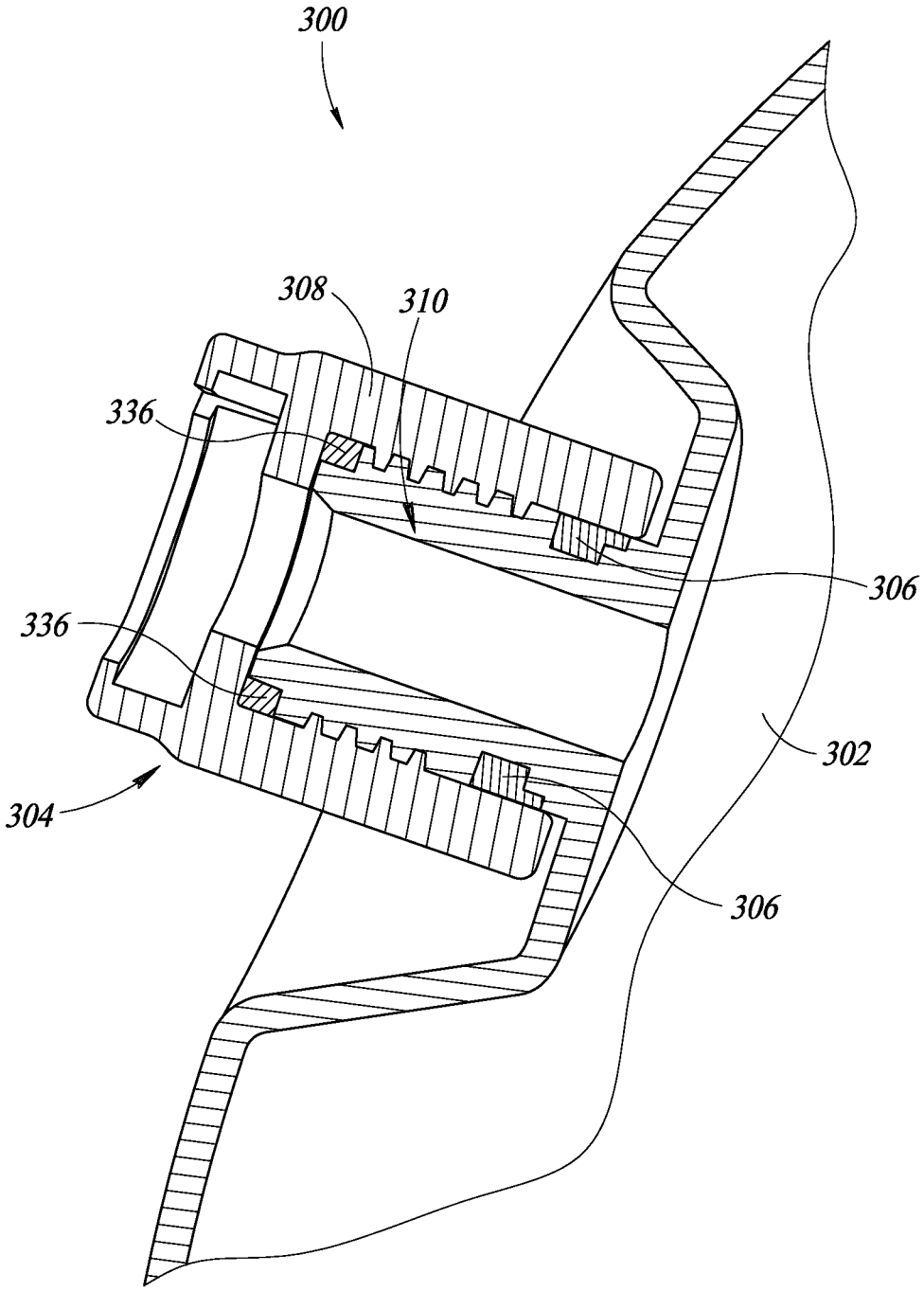
FIG. 16 illustrates a cross-sectional view, corresponding to the cross-sectional view of FIG. 12, of another fluid container.

FIG. 16 illustrates a cross-sectional view, corresponding to the cross-sectional view of FIG. 12, of another fluid container 300. As illustrated in FIG. 16, the fluid container 300 includes many components similar or identical to those described herein for fluid container 100. Except as otherwise described herein, the fluid container 300 may include any of the features described herein for fluid container 100.

As illustrated in FIG. 16, the fluid container 300 includes a fluid tank 302 and a fluid port 304. The fluid port 304 comprises components of the tank 302, including a conduit 310 thereof, a magnetic ring 306, and an adaptor 308. The fluid container 300 differs from fluid container 100 in that it includes a radially- and distally-outward facing groove formed at the distal end of, and in the outer surface of, the conduit 310 of the tank 302. A seal or an o-ring 336 is seated within the groove when the components of the fluid port 304 are assembled, such that the o-ring 336 provides a fluid-tight seal between the tank 302 and the adaptor 308, and more specifically, between the distal end of the conduit 310 of the tank 302 and the adaptor 308.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A diesel exhaust fluid container, comprising:

a tank having an interior, a wall that separates the interior from an external environment, and a conduit that extends through the wall from a first side of the wall to a second side of the wall, wherein the conduit has:

an inner surface, wherein the inner surface faces radially inward with respect to the conduit;

an outer surface opposite the inner surface, wherein the outer surface faces radially outward with respect to the conduit; and a groove that extends circumferentially around the outer surface;

a magnetic ring positioned within the groove; and an adaptor threaded onto the outer surface of the conduit, wherein the magnetic ring is locked within the groove by the adaptor;

wherein the conduit includes a proximal portion adjacent to the wall and having a first outer diameter, an intermediate portion adjacent to the proximal portion and having a second outer diameter smaller than the first outer diameter, and a third portion adjacent to the intermediate portion and having a third outer diameter smaller than the second outer diameter;

wherein the magnetic ring has a proximal portion having a proximal cylindrical inner surface having a first inner diameter, and a distal portion having a distal cylindrical inner surface having a second inner diameter smaller than the first inner diameter;

wherein the second outer diameter matches the first inner diameter and the third outer diameter matches the second inner diameter.

2. The diesel exhaust fluid container of claim 1 wherein the diesel exhaust fluid container complies with ISO 22241.

3. The diesel exhaust fluid container of claimer 1 wherein the magnetic ring has an outer surface having a fourth outer diameter and the fourth outer diameter matches the first outer diameter.

4. The diesel exhaust fluid container of claim 3 wherein the adaptor has an inner surface having a third inner diameter, wherein the third inner diameter matches the first and fourth outer diameters.

5. The diesel exhaust fluid container of claim 1 wherein the magnetic ring extends 360 degrees around the outer surface of the conduit.

6. A diesel exhaust fluid container, comprising:

a tank having an interior, a wall that separates the interior from an external environment, and a conduit that extends through the wall from a first side of the wall to a second side of the wall, wherein the conduit has:

an inner surface, wherein the inner surface faces radially inward with respect to the conduit; and an outer surface opposite the inner surface, wherein the outer surface faces radially outward with respect to the conduit;

a magnetic ring in direct physical contact with the outer surface of the conduit; and an adaptor threaded onto the outer surface of the conduit, wherein the magnetic ring is held in direct physical contact with the outer surface of the conduit by the adaptor;

wherein the conduit includes a proximal portion adjacent to the wall and having a first outer diameter, an intermediate portion adjacent to the proximal portion and having a second outer diameter smaller than the first outer diameter, and a third portion adjacent to the intermediate portion and having a third outer diameter smaller than the second outer diameter;

wherein the magnetic ring has a proximal portion having a proximal cylindrical inner surface having a first inner diameter, and a distal portion having a distal cylindrical inner surface having a second inner diameter smaller than the first inner diameter;

wherein the second outer diameter matches the first inner diameter and the third outer diameter matches the second inner diameter.

7. The diesel exhaust fluid container of claim 6 wherein the diesel exhaust fluid container complies with ISO 22241.

8. The diesel exhaust fluid container of claim 6 wherein the magnetic ring has an outer surface having a fourth outer diameter and the fourth outer diameter matches the first outer diameter.

9. The diesel exhaust fluid container of claim 8 wherein the adaptor has an inner surface having a third inner diameter, wherein the third inner diameter matches the first and fourth outer diameters.

10. The diesel exhaust fluid container of claim 6 wherein the magnetic ring extends 360 degrees around the outer surface of the conduit.

11. A fluid port for a diesel exhaust fluid container, consisting of:

a conduit that extends through a tank wall from a first side of the tank wall to a second side of the tank wall, wherein the conduit has:

an inner surface, wherein the inner surface faces radially inward with respect to the conduit; and an outer surface opposite the inner surface, wherein the outer surface faces radially outward with respect to the conduit;

a magnetic ring mounted on the outer surface of the conduit, wherein the magnetic ring includes a first half ring and a second half ring, wherein the second half ring is separable from the first half ring;

an adaptor threaded onto the outer surface of the conduit; and an o-ring that seals the adaptor to the conduit;

wherein the conduit includes a proximal portion adjacent to the wall and having a first outer diameter, an intermediate portion adjacent to the proximal portion and having a second outer diameter smaller than the first outer diameter, and a third portion adjacent to the intermediate portion and having a third outer diameter smaller than the second outer diameter;

wherein the magnetic ring has a proximal portion having a proximal cylindrical inner surface having a first inner diameter, and a distal portion having a distal cylindrical inner surface having a second inner diameter smaller than the first inner diameter;

wherein the second outer diameter matches the first inner diameter and the third outer diameter matches the second inner diameter.

12. The fluid port of claim 11 wherein the o-ring is in direct physical contact with a distal end of the conduit.

13. The fluid port of claim 11 wherein the o-ring is in direct physical contact with a proximal-facing surface of the adaptor.

14. The fluid port of claim 11 wherein the o-ring is seated within a groove in a proximal-facing surface of the adaptor.

15. The diesel exhaust fluid container of claim 1, wherein the conduit is formed integrally with the wall.

16. The diesel exhaust fluid container of claim 1, wherein the conduit has threads positioned distally with respect to the groove.

* * * * *